United States Patent [19]

Brown et al.

[11] 4,233,907

[45] Nov. 18, 1980

[54] MOLD CONVEYOR DRIVE ASSEMBLY

[75] Inventors: Joe B. Brown, East Lansing; Louis I. Thompson; Stephen P. Mishanec, both of Lansing, all of Mich.

[73] Assignee: Roberts Corporation, Lansing, Mich.

[21] Appl. No.: 954,463

[22] Filed: Oct. 25, 1978

[51] Int. Cl.[3] ..... B61B 13/12; B65G 23/16

[52] U.S. Cl. ..... 104/172 B; 198/793; 198/833

[58] Field of Search ..... 198/833, 472, 729, 793; 104/172 R, 172 B, 172 BT, 172 C; 164/329

[56] References Cited

U.S. PATENT DOCUMENTS

| | | | |
|---|---|---|---|
| 2,609,086 | 9/1952 | McBride et al. | 198/833 X |
| 2,848,102 | 8/1958 | Whitney | 198/833 X |
| 2,868,356 | 1/1959 | Haaff | 198/833 |
| 2,918,020 | 12/1959 | Henderson et al. | 198/833 X |

FOREIGN PATENT DOCUMENTS

| | | | |
|---|---|---|---|
| 1084192 | 6/1960 | Fed. Rep. of Germany | 198/833 |
| 778154 | 7/1957 | United Kingdom | 198/833 |

*Primary Examiner*—James L. Rowland
*Attorney, Agent, or Firm*—Miller, Morriss & Pappas

[57] ABSTRACT

A mold conveyor drive assembly is provided to selectively drive an endless mold conveyor chain with a central unitary driving force exerted along the longitudinal (horizontal) axis of the mold conveyor chain being driven. The mold conveyor drive assembly comprises a vertically oriented endless cat drive chain which is provided with motor drive means. The cat drive chain is positioned below and in spaced-apart register with the mold conveyor chain. The cat drive chain is provided with a plurality of spaced-apart drive dogs along the longitudinal axis thereof which are adapted to be selectively moved into engagement with the mold conveyor chain so as to driveably engage selected of a plurality of corresponding spaced-apart pusher elements provided along the longitudinal axis of the mold conveyor chain and to selectively act upon the mold conveyor chain to decelerate and stop it when desired. Elongate curvilinear guide rail cam means are provided in association with the cat drive chain so as to selectively engage the moving drive dogs when the cat drive chain is actuated by the motor drive means in association therewith. The guide rail cam means are in spaced-apart aligned register with the mold conveyor chain positioned thereabove and are configured to selectively engage and raise the moving drive dogs into driving engagement with the pusher elements of the mold conveyor chain so as to cause the mold conveyor chain to move correspondingly. The guide rail cam means are further configured to maintain the moving drive dogs engaged thereby in continuous driving engagement with the pusher elements of the mold conveyor chain for a predetermined distance and then to selectively lower the drive dogs out of engagement with the pusher elements of the mold conveyor chain.

6 Claims, 16 Drawing Figures

FIG. 5
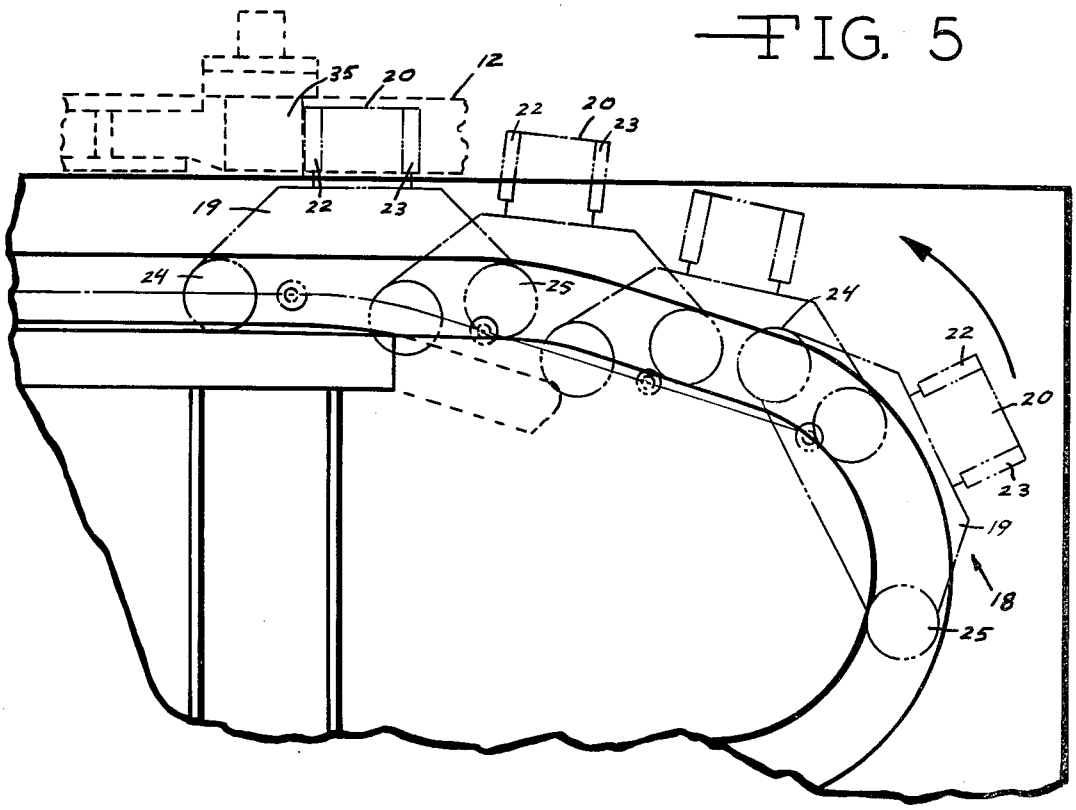
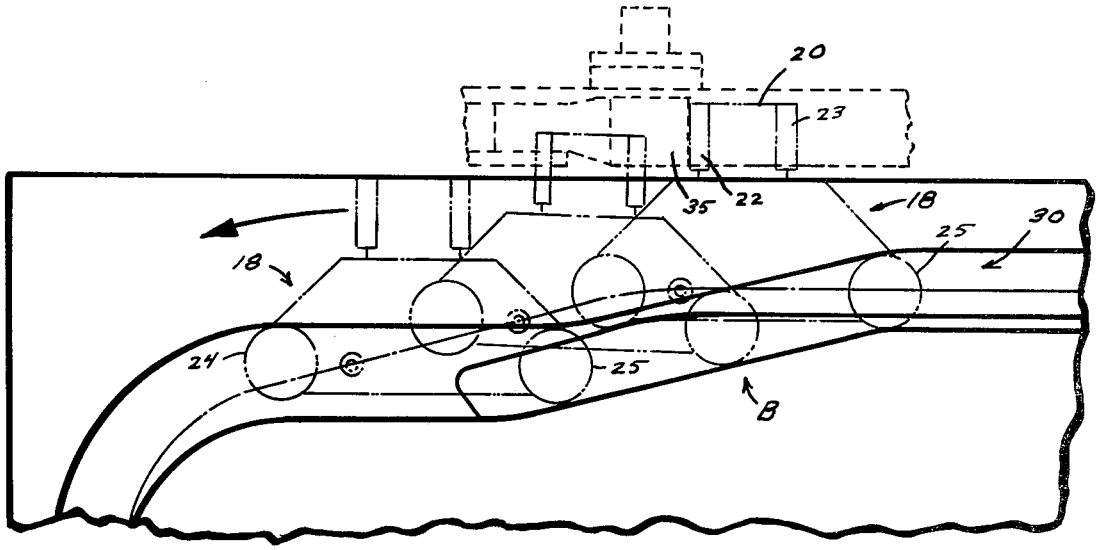
FIG. 6

28
29
30
A
B
25
40
24
38
38a
26
14
16
27
15

MOLD CONVEYOR DRIVE ASSEMBLY

SUMMARY OF THE INVENTION

This invention relates to a mold conveyor drive assembly and more particularly to a vertically oriented endless cat drive chain provided with motor drive means and which is adapted to selectively drive an endless mold conveyor chain with a central unitary driving force exerted upon the mold conveyor chain directly along the longitudinal (horizontal) axis of the mold conveyor chain. The vertically oriented endless cat drive chain is positioned below and in spaced-apart aligned register with the mold conveyor chain. The cat drive chain is provided with a plurality of spaced-apart drive dogs along the longitudinal axis thereof which are adapted to be selectively moved into engagement with the mold conveyor chain so as to driveably engage selected of a plurality of corresponding centrally positioned spaced-apart pusher elements provided along the longitudinal axis of the mold conveyor chain and to selectively act upon the mold conveyor chain to decelerate and stop it when desired. Elongate curvilinear guide rail cam means are provided in association with the cat drive chain so as to selectively engage the moving drive dogs when the cat drive chain is actuated by the motor drive means in association therewith. The guide rail cam means are spaced-apart alinged register with the mold conveyor chain positioned thereabove and are configured to selectively engage and raise the moving drive dogs into driving engagement with the pusher elements of the mold conveyor chain so as to cause the mold conveyor chain to move correspondingly. The guide rail cam means are further configured to maintain the moving drive dogs engaged thereby in continuous driving engagement with the pusher elements of the mold conveyor chain for a predetermined distance and then to selectively lower the drive dogs out of engagement with the pusher elements of the mold conveyor chain. Thus, in driving the mold conveyor chain, the moving drive dogs provided on the cat drive chain are guided and articulated by guide rail cams so that buttress extensions thereof travel vertically up into openings in the mold conveyor chain. Thus, the buttress portion of each drive dog makes contact with the mold conveyor chain on a pusher block or pad (monoplane conveyor) or on a horizontal knuckle (multiple conveyor) provided thereon. The mold conveyor chain is thus designed to selectively accept the buttress portion of the drive dogs within the chain in a loose meshing relationship. The pusher pad is an integral part of the chain. There is no sliding upon contact between the buttress portion of the drive dog and the pusher pad or knuckle. In order to be disengaged from the mold conveyor chain, each drive dog is guided and articulated down and away from the pusher pad, without sliding, until the buttress portion of the drive dog is clear of the mold conveyor chain. The dog as used in the current invention serves a dual purpose in that the back of the buttress portion of the drive dog is used to decelerate and stop the mold conveyor travel through contact of the mold conveyor chain and the back of the buttress portion of the drive dog. This eliminates the need for separate anti-runaway dogs on the cat chain.

As will be hereinafter described, the mold conveyor chain is also integrally provided with a plurality of guide wheels positioned intermediate the pusher pads or blocks. The guide wheels are rollably positioned between guide wheel rails provided in the conveyor support frame.

It is thus seen that the drive dogs do not driveably engage the mold conveyor guide wheels but instead bear directly upon the pusher pads or blocks which are centrally positioned along the longitudinal axis of the mold conveyor chain. For this reason, the mold conveyor guide wheel will not get flat spots on it caused by the scrubbing action against a guide wheel rail while it is held stationary, i.e. kept from rotating, by the drive dog.

The mold conveyor guide wheel can thus be freely and easily guided throughout its entire passage through the drive area.

In the devices of the prior known art, flat spots occur on the mold conveyor chain guide wheel through direct contact with the drive dogs. Further, the devices of the prior known art generally utilize yoke-type drive elements with which to engage and drive the horizontally oriented mold conveyor chain. This results in off-center drive forces being exerted upon the mold conveyor chain with resultant uneven wear in the components thereof due to the repeated lateral shifting of the chain in response to the off-center drive forces. In contrast, the instant invention provides that the mold conveyor chain is driven by a central unitary force exerted along the horizontal (longitudinal) axis of the mold conveyor chain.

Futher, due to the fact that in the instant invention the drive dogs do not bear against the mold conveyor chain guide wheels in order to drive the mold conveyor chain, the capacity of the bearings in the guide wheel does not have to withstand the entire accumulated pull of the mold conveyor chain. The bearing life is increased through the elimination of high loading of the bearings in a static (non-rotating position).

PRIOR ART

None of the known prior art devices show or otherwise anticipate a mold conveyor drive assembly which comprises a vertically oriented endless cat drive chain which is provided with a plurality of spaced-apart drive dogs along the longitudinal axis thereof which are adapted to driveably engage selected of a plurality of corresponding spaced-apart pusher block elements internally provided on the mold conveyor chain so as to be centrally positioned along the horizontal (longitudinal) axis of the mold conveyor drive chain. None of the prior art devices teach the use of drive dogs which are by use of guide rail cam means lifted into a loosely meshing engagement with a mold conveyor chain so as to driveably engage pusher members provided therein. None of the prior art devices teach the use of drive dogs moved into engagement with the mold conveyor chain so as to not only drive the mold conveyor chain but which selectively acts to decelerate and stop the mold conveyor travel through contact of the mold conveyor chain and the back of the drive dog. Examples of the known prior art are seen in the U.S. Pat. Nos. to Bachelder 6,604, McCaslin 486,809, Hass 1,591,422, Aiken 1,692,322, Lemmon 1,973,005, Aisher 2,090,928, Ingraham 2,664,592, Sukava 2,763,904 and Bowden 3,512,575.

It is therefore an object of the invention to provide a mold conveyor drive assembly in association with a mold conveyor chain wherein drive dogs provided on a vertically oriented cat drive chain are lifted into selective driveable engagement with spaced-apart pusher blocks centrally provided on the mold conveyor chain along the horizontal (longitudinal) axis thereof.

Another object of this invention is to provide a mold conveyor drive assembly wherein the mold conveyor chain is driven by a unitary centrally directed driving force exerted directly upon the mold conveyor drive chain assembly along a horizontal line formed by the intersection of the horizontal (longitudinal) and vertical axes of the mold converyor drive chain.

Another object of this invention is to provide a mold conveyor drive assembly wherein the mold conveyor chain guide wheels are not driveably engaged by the drive dogs provided on the cat drive chain associated therewith but are freely guided throughout their passage through the drive area.

A still further object of this invention is to provide a mold conveyor drive assembly wherein the drive dogs are selectively meshed directly into the mold conveyor chain so as to driveably engage the pusher blocks provided on the mold conveyor chain and to selectively act upon the mold conveyor chain so as to decelerate and stop the mold conveyor chain when required.

Other objects of this invention will be apparent to those skilled in the art upon reading the present description, drawings and claims.

IN THE DRAWINGS

FIG. 5 is a schematic animation view showing the drive dog in association with guide rail cam elements being guided into driving engagement with the pusher member of the mold conveyor chain.

FIG. 6 is a schematic animation view showing the drive dog in association with guide rail cam elements being guided out of engagement with the mold conveyor chain.

FIG. **9*a*** is a partial perspective schematic view of a drive dog in engagement with the mold conveyor pusher block and showing in phantom line the horizontal (longitudinal) axis along which the drive dog exerts a central unitary drive force against the pusher block.

FIG. **9*b*** is a partial cross-sectional view of the mold conveyor chain showing a centrally positioned drive dog in drive engagement with a pusher block provided in the mold conveyor chain.

Figures 10, 11, 12:
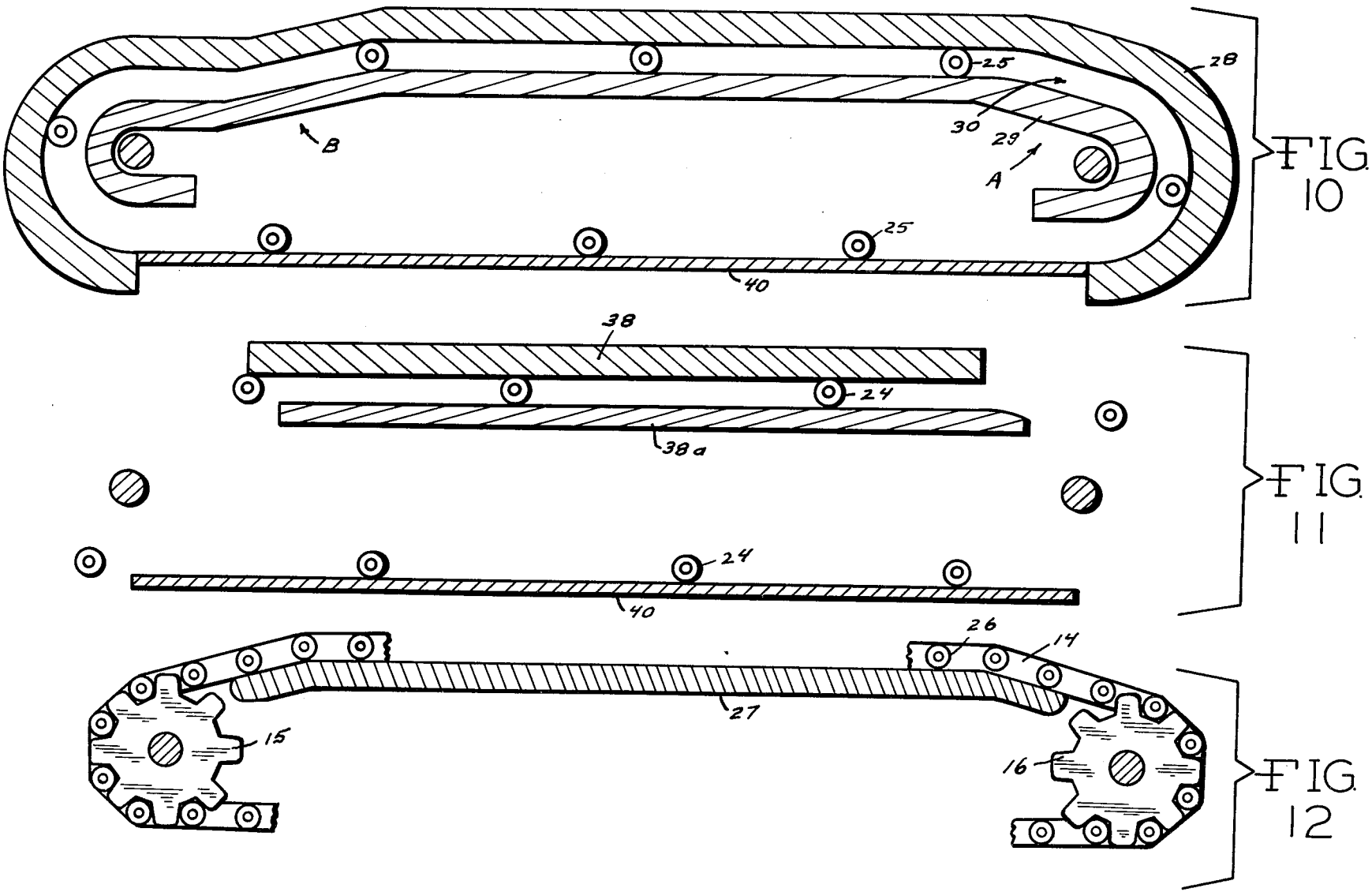

FIG. 10 is a side schematic view showing the cam guide rail assembly which engages the rear wheels of the drive dogs.

FIG. 11 is a side schematic view showing the cam guide rail assembly which engages the front wheels of the drive dogs.

FIG. 12 is a partial side schematic view of the vertically oriented cat drive assembly and support cam guide rail in association therewith.

Figure 13:
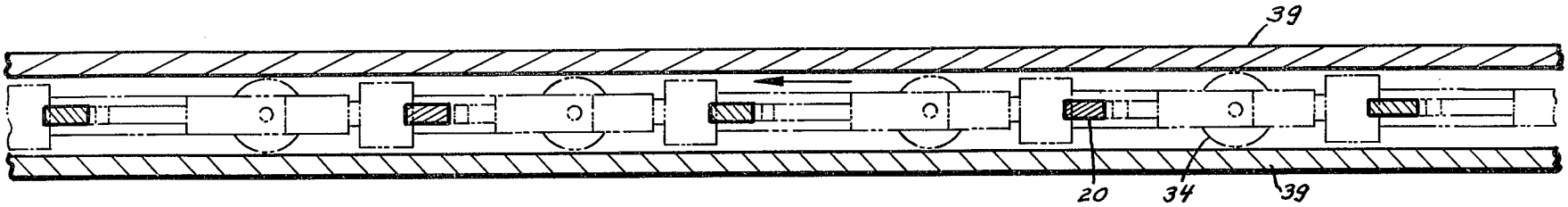

FIG. 13 is a top schematic view of the mold conveyor chain positioned between guide wheel cam rails and shown in the drive dogs in engagement therewith.

Figure 14:
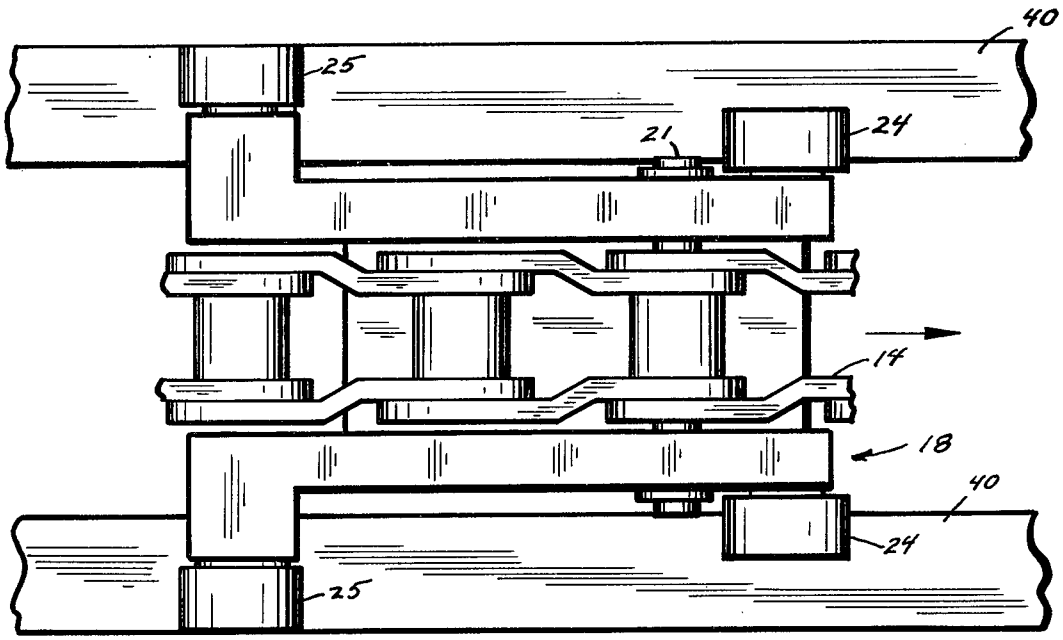

FIG. 14 is a bottom schematic view of a drive dog assembly is association with the mold conveyor chain.

DESCRIPTION

Figure 1:
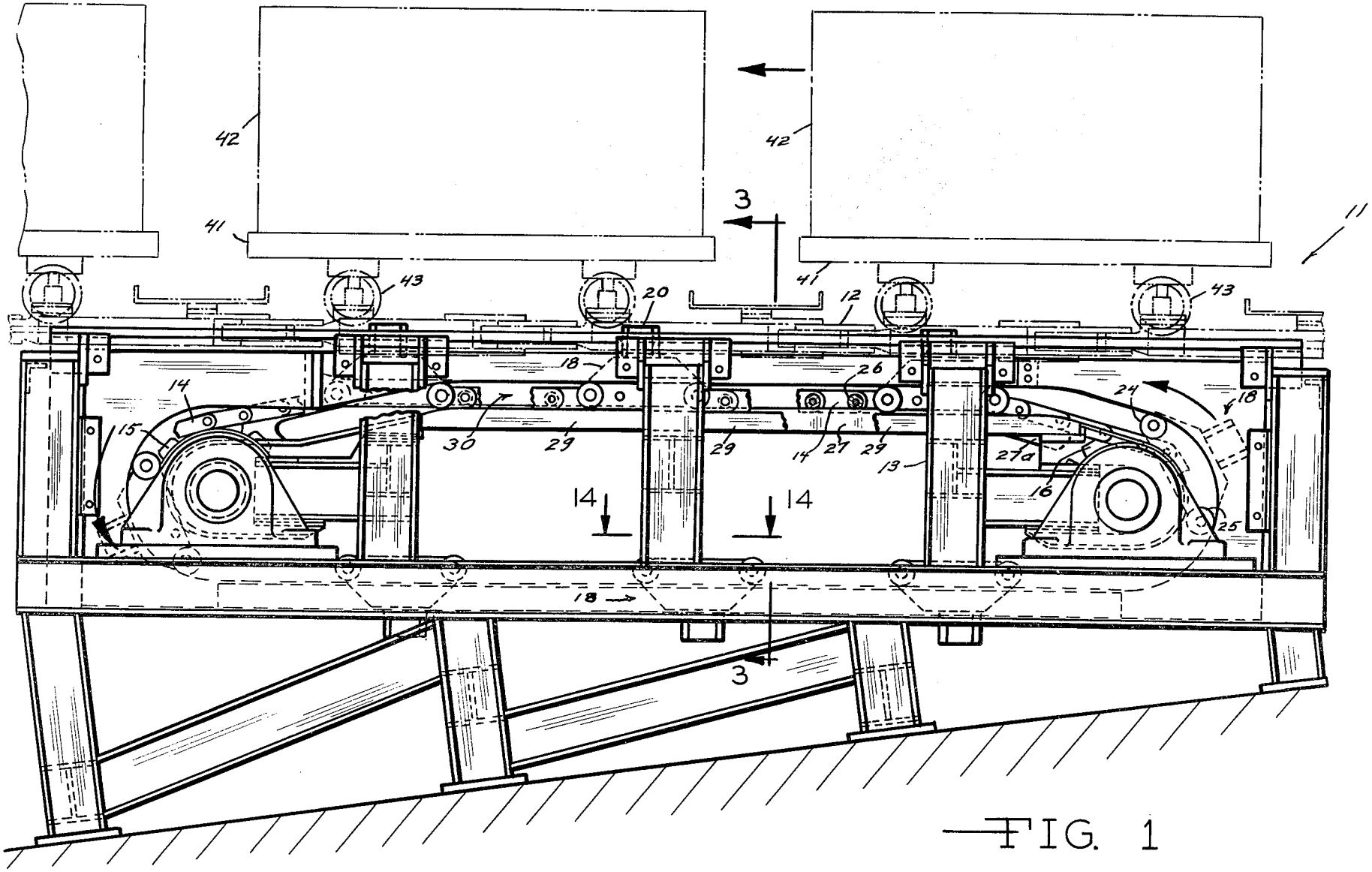
FIG. 1 is a side elevation view of the mold conveyor drive assembly showin the vertically oriented cat drive chain positioned below the horizontally oriented mold conveyor chain and showing the vertically oriented cat chian drive dogs which driveably engage pusher block members provided in the mold conveyor chain positioned thereabove.
Figure 2:
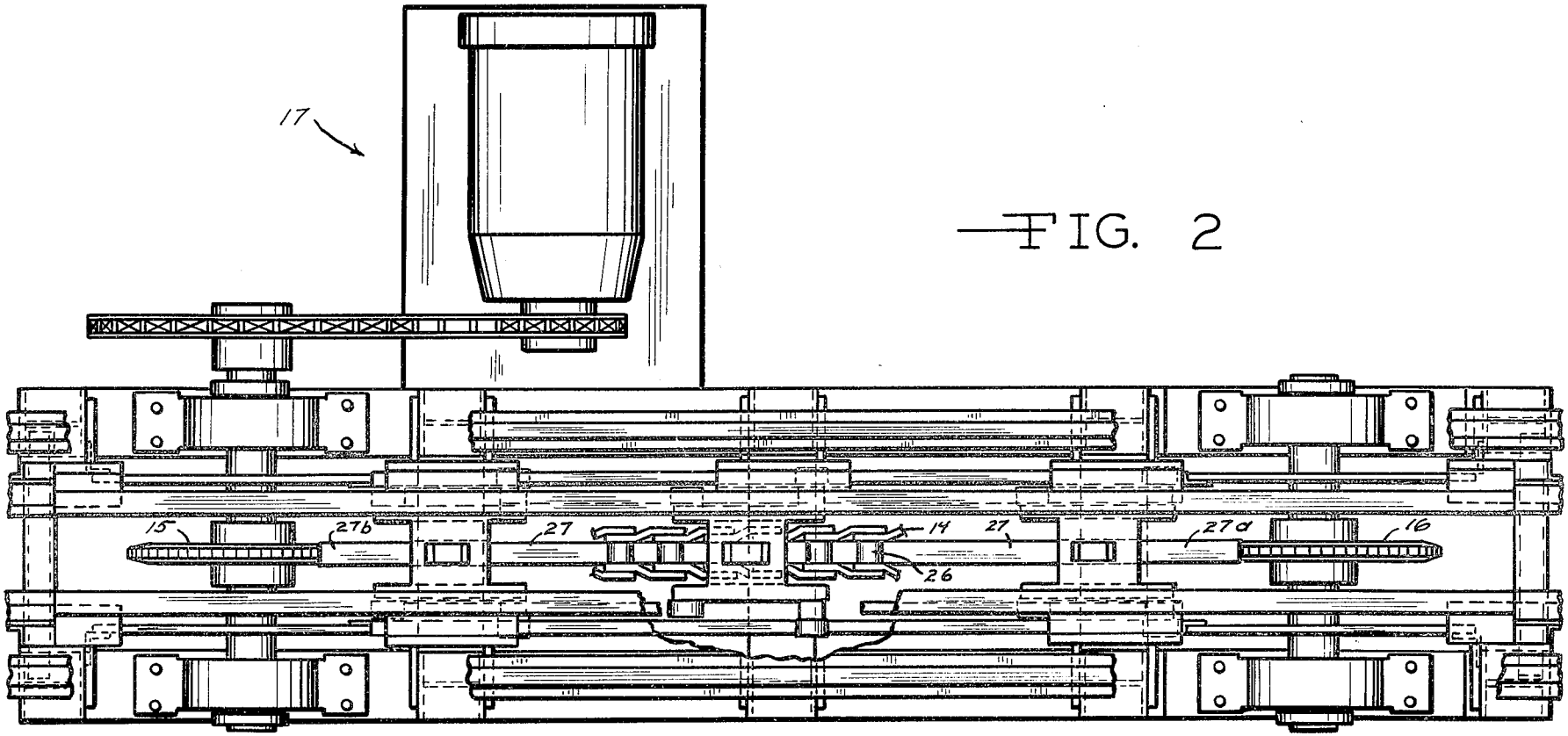
FIG. 2 is a top view of a portion of the mold conveyor chain and showing the vertically oriented cat chain drive positioned therebelow.

As shown in FIGS. 1 and 2, a mold conveyor drive assembly 11 consists of a horizontally oriented endless mold conveyor chain 12 positioned on a support frame 13, a vertically oriented endless cat drive chain 14 positioned below and in spaced-apart longitudinally aligned register with a rectilinear portion of the mold conveyor chain 12. The cat drive chain 14 is mounted on head and foot sprockets 15 and 16, respectively. Motor drive means 17 are provided in association with head sprocket 15 so as to selectively drive the cat drive chain 14. The cat drive chain 14 is provided with a plurality of spaced-apart drive dog assemblies 18.

Figure 3:
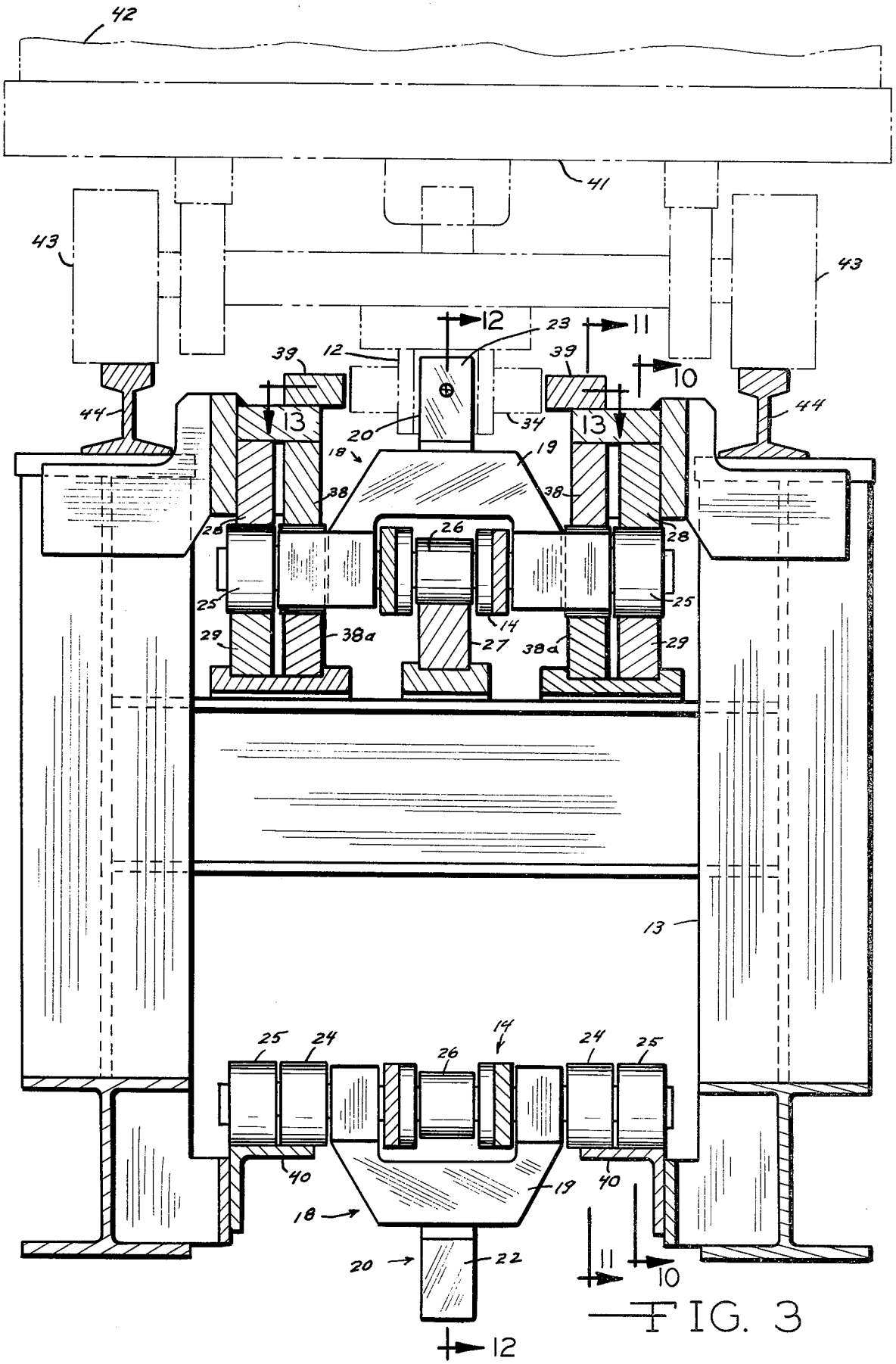
FIG. 3 is a cross-sectional view taken on line 3—3 of FIG. 1 showing the drive dog in its driving engagement position with the mold conveyor chain showing in phantom line.
Figure 4:
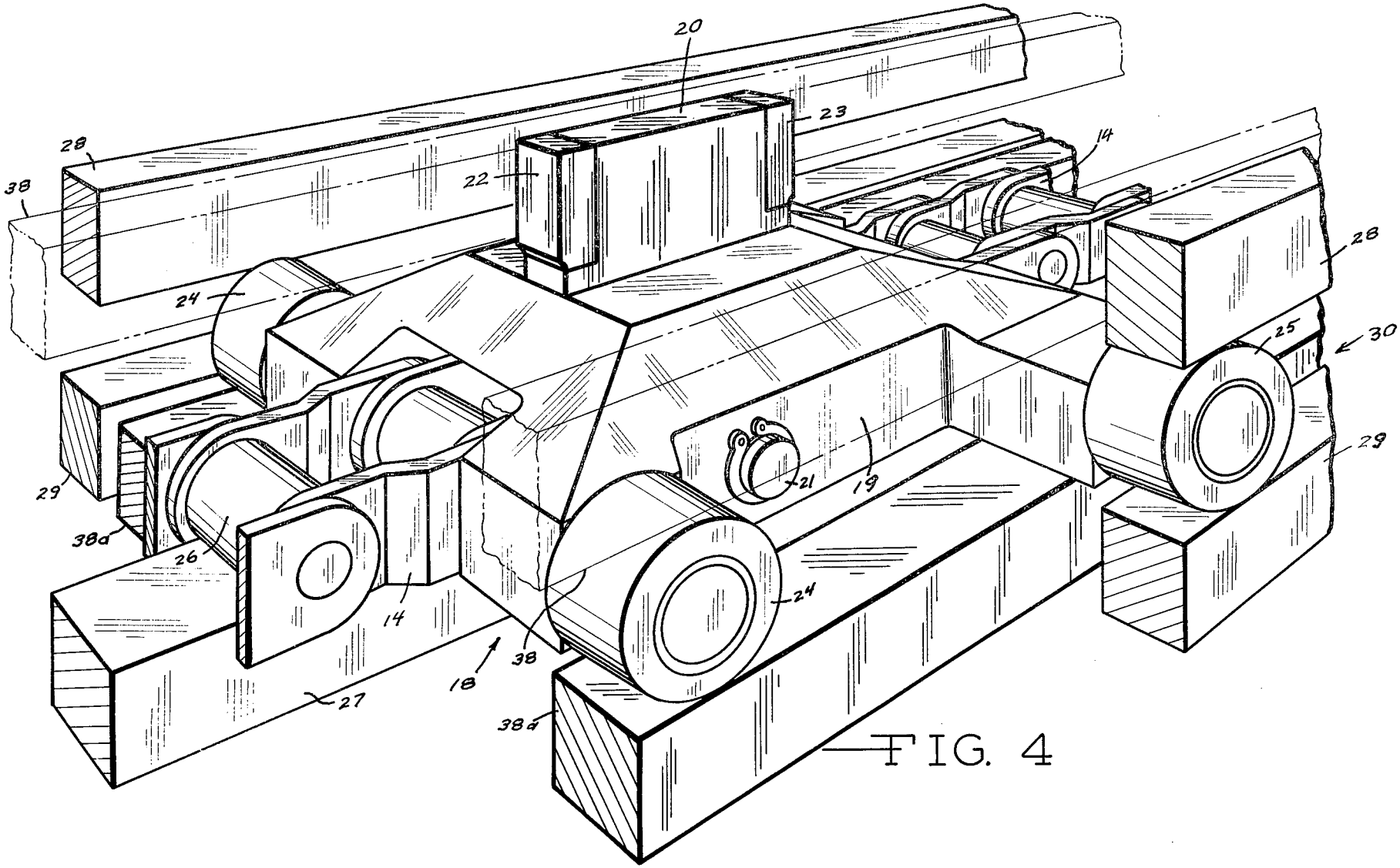
FIG. 4 is a perspective view of the drive dog assembly, a portion of the cat drive chain and showing a portion of the guide rail cam elements associated therewith.

As shown more specifically in FIGS. 3 and 4, each drive dog 18 is comprised of a carriage body portion 19 and an upwardly extending mold conveyor-engaging buttress portion 20. The carriage body portion 19 of the drive dog 18 is affixed to the cat drive chain 14 by pin 21. The buttress portion 20 is provided with vertically oriented front and rear wear pad portions 22 and 23, respectively. Each drive dog 18 is provided with forward and rear pairs of cam-engaging wheels 24 and 25, respectively.

As shown in FIGS. 1 and 12, the cat drive chain 14 is provided with a plurality of rollers 26 which rollably engage and are supported by cat chain support cam guide rail 27 which is positioned below and substantially parallel to the mold conveyor chain 12. The cat chain support cam guide rail 27 provides support to stop deflection of the drive dogs 18 when they are engaged to the mold conveyor chain.

As shown in FIGS. 3, 5 and 10, upper and lower spaced-apart pairs of rear wheel guide rail cam elements 28 and 29, respectively, cooperate to form spaced-apart channels 30 which engage the rear wheels 25 of each drive dog 18. The spaced-apart pairs of rear wheel guide rail cam elements 28 and 29 are configured so that the channels 30 formed thereby begin on either side of the foot sprocket 16 and extend upwardly therearound. As shown in FIG. 5, the channels 30 are configured to slope upwardly at point A so that the rear wheels 25 of the drive dog 18 are guided upwardly so as to bring the buttress 20 of the drive dog 18 into meshing engagement with the mold conveyor chain 12. As shown in FIGS. 3, 5, 7 and 9, the buttress portion 20 of the drive dog 18 is moved into and maintained in meshing drive engagement with the mold conveyor chain 12 along the rectilinear portion thereof.

The mold conveyor chain 12 is formed by a plurality of pairs of spaced-apart connector elements 32 and 33, which join to support a plurality of spaced-apart guide wheels 34 and pusher blocks 35 therebetween. It should be noted that although pusher blocks 35 are utilized in a monoplane conveyor, it is within the scope of the invention to utilize horizontal knuckles (not shown) as pusher members when a multiplane conveyor is utilized.

Figure 8:
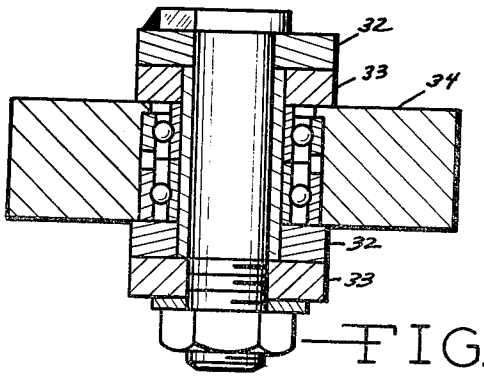
FIG. 8 is a cross-sectional view taken on line 8—8 of FIG. 7 showing one of the guide wheels provided in the mold conveyor chain.
Figure 9:
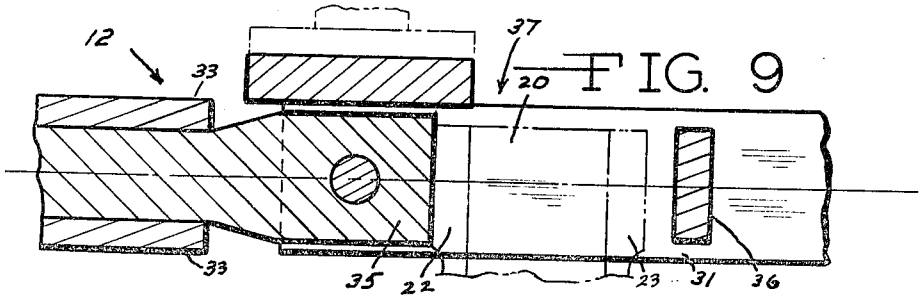
FIG. 9 is a cross-sectional view taken on line 9—9 of FIG. 7 showing the drive dog in phantom line in driving engagement with one of the pusher blocks of the mold conveyor chain along the horizontal (longitudinal) axis of the mold conveyor chain.

In the preferred embodiment of the invention, the mold conveyor chain 12 is comprised of interconnected link assemblies consisting of a plurality of pivotally connected pairs of link connectors 32 and 33, respectively, having a guide wheel 34 rotatably mounted therebetween. The pivotal mounting of the guide wheel 34 is shown in the cross-sectional view of FIG. 8. The link connectors 33 fixedly support an end of the pusher block 35 therebetween. The opposite end of the pusher block 35 is bracketed by and pivotally connected to a pair of vertically oriented spaced-apart pusher block links 31 which extend into fixed engagement with the connector links 32 of the next adjacent link assembly so as to form the continuous mold conveyor chain. As shown in FIG. 9, a cross bar stop member 36 is fixedly positioned between the pusher block links 31 in a spaced-apart opposing relationship with the end surface of the pusher block 35.

Thus positioned, each of the spaced-apart vertically oriented pusher block links 31, the pusher blocks 35 and the cross bar stop members 36 cooperate to define a plurality of spaced-apart drive dog buttress-receiving openings 37 along the longitudinal axis of the mold conveyor chain 12. As shown in FIGS. 5, 6 and 9, the buttress 20 of each drive dog 18 is programmed to move upwardly into its respective buttress-receiving opening 37 in the mold conveyor chain 12 so as to driveably engage the pusher block 35. As shown in FIG. 9, the front wear pad 22 of the buttress 20 bears against the pusher block 35. The movement of the drive dog 18 is such that there is no sliding upon contact between the wear pad 22 of the drive dog 18 and the pusher block 35.

Thus positioned within the opening 37, the forward wear pad 22 of the drive dog 18 driveably acts upon the pusher block 35 to correspondingly move the mold conveyor chain 12 when the cat drive chain 14 is moving in the direction indicated in FIG. 5. When cat drive chain slows down and stops, the rear wear pad 23 of the drive dog 18 engages the cross bar stop member 36 so as to correspondingly decelerate and stop the mold conveyor chain 12. This eliminates the need for separate anti-runaway dogs on the cat drive chain.

Figure 9A:
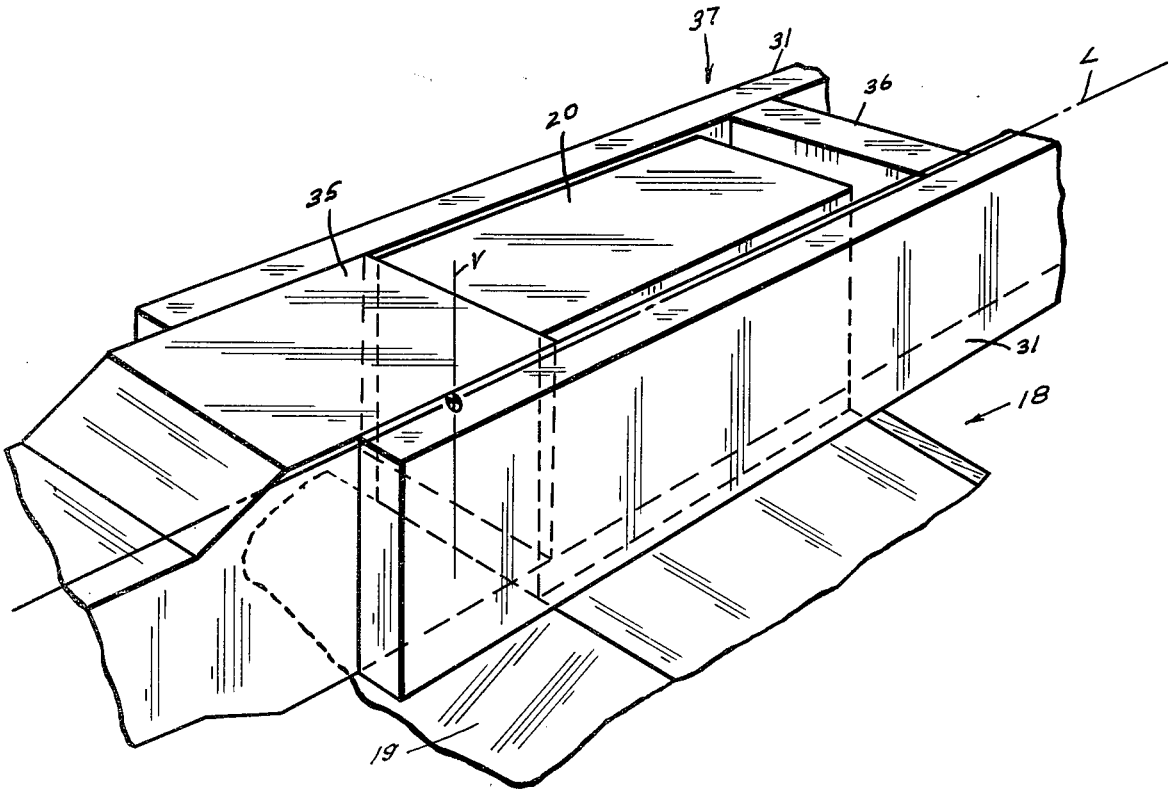
Figure 9B:
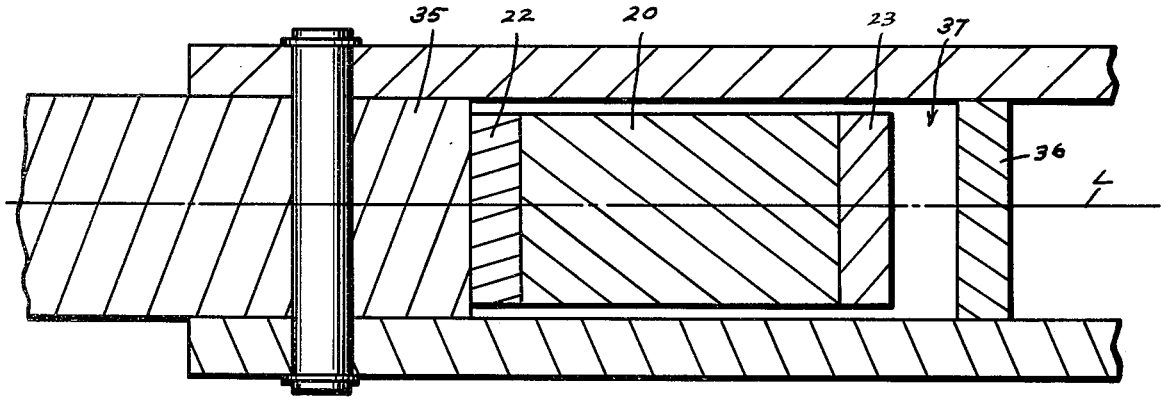

As shown in FIGS. 9*a* and 9*b*, the central unitary driving force imparted by each drive dog buttress 20 against the corresponding pusher block 35 of the mold conveyor chain 12 is centered along the longitudinal axis of the mold conveyor chain. Thus, the driving force acting on the mold conveyor chain is centered along the longitudinal axis thereof and thus does not cause undesirable lateral shifting in the mold conveyor chain while it is being driven.

As shown in FIGS. 6 and 10, the cam channels 30 are sloped downwardly at point B so that each drive dog 18 is guided and articulated down and away from the pusher block 35, without sliding, out of the opening 37 until the drive dog 18 is clear of the mold conveyor chain 12.

As shown in FIG. 3, spaced-apart front wheel upper guide cam rails 38 are provided below and in aligned register with the mold conveyor chain 12 so as to engage the tops of the front wheels 24 of the drive dog 18 and hold them down in their level operative use position as the drive dogs 18 horizontally move below the mold conveyor 12. Corresponding front wheel guide cam rails 38*a* are positioned so as to engage the bottoms of the front wheels 24 as shown in FIGS. 3 and 11.

As shown in FIGS. 3 and 13, horizontally oriented spaced-apart guide wheel cam rails 39 are provided so as to bracket the mold conveyor chain 12 therebetween so as to guide the guide wheels 34 along and throughout their passage through the drive area above the cat drive chain 14.

As shown in FIGS. 10, 11 and 14, spaced-apart wheel support bars 40 are provided along the base of the support structure 13 between the head and foot sprockets 15 and 16, respectively, of the cat drive chain 14 so as to supportably engage the wheels 24 and 25 of drive dogs 18 as the drive dogs 18 are returned on the lower rectilinear portion of the cat drive chain 14.

Figure 7:
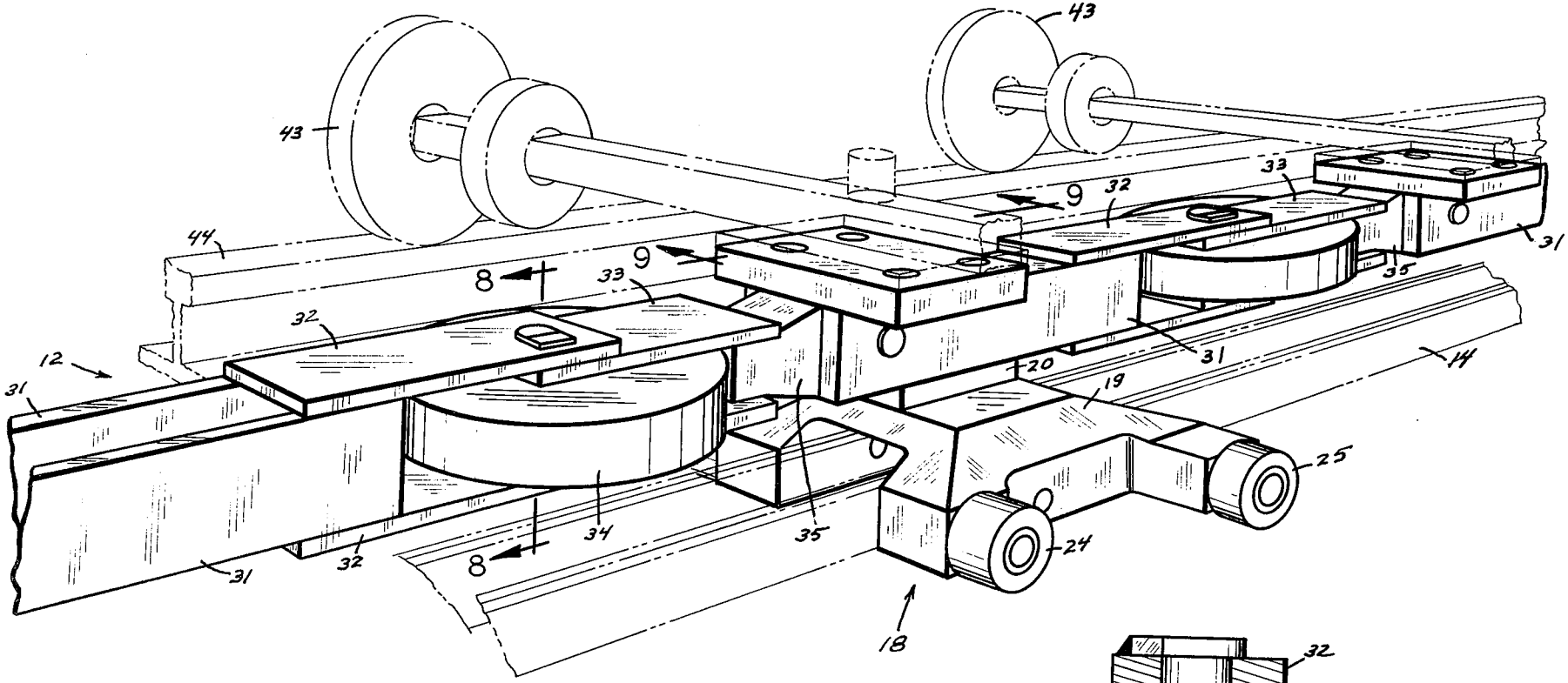
FIG. 7 is a perspective view of the mold conveyor chain with the drive dog in driving engagement therewith.

As shown schematically in FIGS. 1, 3 and 7, a plurality of spaced-apart mold-carrying cars 41 are provided on the mold conveyor chain 12 so as to carry molds 42 therealong. The mold-carrying cars 41 are provided with wheels 43 which rollably engage spaced-apart rails 44 located on each side of the mold conveyor chain 12.

It is thus seen that a mold conveyor drive assembly is provided for driving a mold conveyor chain. The mold conveyor drive assembly is comprised of a support frame. A mold conveyor chain is provided on the support frame. A plurality of spaced-apart drive dog buttress-receiving openings are provided along the longitudinal axis of the mold conveyor chain. A drive dog buttress-engaging pusher block is provided at one end of each of the buttress-receiving openings provided in the mold conveyor chain. A vertically oriented endless cat drive chain is also provided on the support frame below a rectilinear portion of the mold conveyor chain and in spaced-apart aligned register therewith. The cat drive chain is provided with a plurality of spaced-apart drive dog means which have mold conveyor chain-engaging buttress portions provided thereon. Drive dog-engaging cam means are provided on the support frame adjacent the cat drive chain. The drive dog-engaging cam means are adapted to guidably direct selected of the drive dog means so that the buttress portions thereof are moved into the buttress-receiving openings so as to driveably engage the pusher means provided in the mold conveyor chain. Motor drive means are provided in association with the cat drive chain so as to selectively actuate the cat drive chain so as to cause corresponding movement of the mold conveyor chain. The mold conveyor chain is provided with a plurality of spaced-apart guide wheels which are adapted to rollably engage guide wheel cam rails provided on the support frame along each side of the mold conveyor chain. In the embodiment of the invention shown in the drawings and described herein, each of the drive dog means comprise a carriage portion and a buttress portion. The carriage portion is provided with front and rear pairs of wheels which engage the drive dog-engaging cam means so as to selectively guide the drive dog means into and out of operative engagement with the mold conveyor chain. The drive dog-engaging cam means define a channel along each side and spaced-apart from the cat drive chain. The channels are adapted to selectively guidably engage the rear wheels of the drive dogs so as to guidably direct the buttress portions of the drive dogs into driveable engagement with the pusher block means of the mold conveyor chain.

A plurality of buttress-engaging cross bar stop means are provided on the mold conveyor chain. Each of the cross bar stop means are positioned at the end of each of the buttress-receiving openings opposite the pusher means. The cross bar stop means are adapted to be selectively engaged by the backs of the buttress portions of the drive dogs so as to decelerate and stop the mold conveyor chain upon corresponding movement of the cat drive chain. A plurality of spaced-apart mold-carrying cars or carts are provided in association with the mold conveyor chain. The mold-carrying carts are provided with wheels which rollably engage tracks provided on the support frame along each side of the mold conveyor chain. Thus molds can be conveyed along a path delineated by the layout of the mold conveyor chain from one work site to another.

It is thus seen that a positive control mold conveyor drive assembly is provided which comprises a vertically oriented endless cat drive chain which is positioned below a mold conveyor chain. The cat drive chain is provided with a plurality of spaced-apart drive dog members having buttress elements which are selectively moved into meshing engagement with the mold conveyor chain so as to driveably engage pusher elements provided in the conveyor chain. Cam means in association with the cat drive chain guide the drive dogs upwardly so that the buttress portions thereof move into the buttress-receiving openings provided in the mold conveyor chain so as to directly driveably engage the pusher members without making sliding contact therewith. Thus positioned in the buttress-receiving opening of the mold conveyor chain, the buttress element can selectively drive the mold conveyor chain or can selectively act thereupon so as to decelerate and stop it as desired. Further, thus positioned, the buttress portions are adapted to exert a central unitary drive force against selected of the pusher block means along the longitudinal (horizontal) axis of the mold conveyor chain.

From the presentation of an operative embodiment of my invention, improvements, modifications, and substitutions will become apparent to those skilled in the art. Such improvements, modifications and substitutions are intended to be included within the spirit of the invention limited only by the scope of the hereinafter appended claims.

We claim:

1. A mold conveyor drive assembly for driving a mold conveyor chain comprising:

a support frame;

a mold conveyor chain provided on said support frame, said mold conveyor chain defining a plurality of spaced-apart drive dog buttress-receiving openings therein, said mold conveyor chain provided with drive dog buttress-engaging pusher block means at one end of each of said buttress-receiving openings;

a vertically oriented endless cat drive chain mounted on said support frame in spaced-apart aligned register below a rectilinear portion of said mold conveyor chain, said cat drive chain provided with a plurality of spaced-apart drive dog means having mold conveyor chain-engaging buttress portions thereon, said buttress portions adapted to make selective meshing engagement with said buttress-receiving openings so as to exert a central unitary drive force against selected of said pusher block means along the longitudinal axis of said mold conveyor chain;

a plurality of spaced-apart guide wheels provided on said mold conveyor chain intermediate said drive dog buttress-receiving openings;

guide wheel cam rails provided on the support frame along each side of said mold conveyor chain, said cam rails adapted to guidably direct said guide wheels therebetween upon corresponding movement of said mold conveyor chain; and motor drive means in association with said cat drive chain, said motor drive means adapted to selectively actuate said cat drive chain so as to cause corresponding movement of said mold conveyor chain.

2. A mold conveyor drive assembly for driving a mold conveyor chain comprising:

a support frame;

a mold conveyor chain provided on said support frame, said mold conveyor chain defining a plurality of spaced-apart drive dog buttress-receiving openings therein, said mold conveyor chain provided with drive dog buttress-engaging pusher block means at one end of each of said buttress-receiving openings;

a vertical oriented endless cat drive chain mounted on said support frame in spaced-apart aligned register below a rectilinear portion of said mold conveyor chain, said cat drive chain provided with a plurality of spaced-apart drive dog means having mold conveyor chain-engaging buttress portions thereon;

drive dog-engaging cam means mounted on said support frame adjacent with said cat drive chain, said drive dog-engaging cam means adapted to guidably direct selected of said drive dog means so that the buttress portions thereof are moved into said buttress-receiving openings to driveably engage said pusher means provided in said mold conveyor chain, said buttress portions adapted to exert a central unitary force against selected of said pusher block means along the longitudinal axis of said mold conveyor chain;

a plurality of spaced-apart guide wheels provided on said mold conveyor chain intermediate said drive dog buttress-receiving openings;

guide wheel cam rails provided on the support frame along each side of said mold conveyor chain, said cam rails adapted to guidably direct said guide wheels therebetween upon corresponding movement of said mold conveyor chain; and motor drive means in association with said cat drive chain, said motor drive means adapted to selectively actuate said cat drive chain so as to cause corresponding movement of said mold conveyor chain.

3. In the mold conveyor drive assembly of claim 2 wherein each of said drive dog means comprises a carriage portion and a buttress portion, said carriage portion provided with front and rear pairs of wheels adapted to engage said drive dog-engaging cam means so as to selectively guide said drive dog means into and out of operative engagement with said mold conveyor chain.

4. In the mold conveyor drive assembly of claim 3 wherein said drive dog-engaging cam means define a channel along each side and spaced-apart from said cat drive chain, said channels adapted to guidably engage said rear pairs of wheels of said drive dog means so as to guidably direct said buttress portion into driveable engagement with said pusher means.

5. In the mold conveyor drive assembly of claim 2 wherein a plurality of buttress-engaging cross bar stop means are provided on said mold conveyor chain, each of cross bar stop means positioned at the end of each of said buttress-receiving openings opposite said pusher means, said cross bar stop means adapted to be selectively engaged by said buttress portions of said drive dogs so as to decelerate and stop said mold conveyor chain upon corresponding movement of said cat drive chain.

6. In the mold conveyor drive assembly of claim 2 wherein a plurality of spaced-apart mold-carrying carts are provided in association with said mold conveyor chain, said mold-carrying carts provided with wheels which rollably engage tracks provided on said support frame along each side of said mold conveyor chain.

* * * * *